US009074311B2

(12) United States Patent
Lee et al.

(10) Patent No.: US 9,074,311 B2
(45) Date of Patent: Jul. 7, 2015

(54) STEAM GENERATOR AND WASHING MACHINE HAVING THE SAME

(75) Inventors: Sang Heon Lee, Seoul (KR); Woo Young Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 927 days.

(21) Appl. No.: 13/045,909

(22) Filed: Mar. 11, 2011

(65) Prior Publication Data

US 2011/0219824 A1 Sep. 15, 2011

(30) Foreign Application Priority Data

Mar. 12, 2010 (KR) ..... 10-2010-0022316
Mar. 12, 2010 (KR) ..... 10-2010-0022317
Mar. 12, 2010 (KR) ..... 10-2010-0022318

(51) Int. Cl.
*D06F 39/00* (2006.01)
*F22B 1/28* (2006.01)

(52) U.S. Cl.
CPC ..... *D06F 39/008* (2013.01); *F22B 1/284* (2013.01)

(58) Field of Classification Search
CPC ..... D06F 39/008
USPC ..... 68/5 C
See application file for complete search history.

(56) References Cited

U.S. PATENT DOCUMENTS

| | | | | |
|---|---|---|---|---|
| 3,813,517 | A * | 5/1974 | McGruder | 219/438 |
| 5,869,812 | A * | 2/1999 | Creamer et al. | 219/401 |
| 2008/0115740 | A1 | 5/2008 | You | |
| 2008/0256990 | A1 * | 10/2008 | Cho | 68/5 C |
| 2008/0271500 | A1 * | 11/2008 | Ahn | 68/5 C |
| 2009/0139550 | A1 | 6/2009 | Lim | |

FOREIGN PATENT DOCUMENTS

| | | | |
|---|---|---|---|
| CN | 1721616 | A | 1/2006 |
| CN | 101024915 | A | 8/2007 |
| CN | 101096815 | A | 1/2008 |
| CN | 101187138 | A | 5/2008 |
| CN | 101290111 | A | 10/2008 |
| DE | 4443798 | C1 | 3/1996 |
| EP | 1464750 | B1 | 9/2009 |
| RU | 2339751 | C2 | 11/2008 |
| RU | 2362850 | C1 | 7/2009 |
| WO | 2007/086672 | A1 | 8/2007 |
| WO | 2007/104846 | A2 | 9/2007 |

* cited by examiner

*Primary Examiner* — Michael Barr
*Assistant Examiner* — Spencer Bell
(74) *Attorney, Agent, or Firm* — McKenna Long & Aldridge LLP

(57) ABSTRACT

The present invention relates to steam generator and a washing machine having the same which can minimize remained water in the steam generator, and can prevent the water stored in the steam generator from leaking and the water in the steam generator from being supplied to the clothes together with the steam due to a spray pressure of the steam.

22 Claims, 7 Drawing Sheets

(a)

(b)

(c)

STEAM GENERATOR AND WASHING MACHINE HAVING THE SAME

Pursuant to 35 U.S.C. §119(a), this application claims priority to Korean Patent Application No. 10-2010-0022316, 10-2010-0022317, 10-2010-0022318, filed on Mar. 12, 2010, which is hereby incorporated by reference in its entirety as if fully set forth herein.

DESCRIPTION

1. Technical Field

The present invention relates to a steam generator and a washing machine having the same.

2. Background Art

In general, the washing machine is a general term of a domestic appliance including an appliance which removes dirt from laundry by washing water supplied to the appliance and an action of detergent and an appliance which supplies hot air to wet laundry for drying the laundry.

In the meantime, it is a feature of a current washing machine that the washing machine can sterilize, deodor, and remove crumples from the laundry by using the steam generator.

A related art steam generator, which generates steam by heating water supplied from an outside of the steam generator with a heater, is provided with storage means for storing water, and a heater in the storage means to be in contact with the water stored therein, directly.

In order to secure safety such as overheating prevention of the heater, the steam generator puts the heater into operation only when the heater is submerged in the water fully. That is, the related art steam generator re-supplies the water after stopping operation of the heater if the heater is not submerged under the water even if a certain amount of the water is remained in the storage means.

Therefore, the related art steam generator or the washing machine having the same does not have a structure in which the water is re-supplied after all the water supplied to the steam generator is consumed, but has a structure in which the water is re-supplied after generation of the steam (heater operation) is stopped if the heater appears out of a surface of the water.

That is, since the related art steam generator or the washing machine having the same puts the heater into operation after re-supply of the water even if there is water remained in the steam generator, the related art steam generator or the washing machine having the same has a problem in that entire water initially supplied can not be supplied in steam.

Moreover, since the related art steam generator or the washing machine having the same is required to put the heater into operation after re-supply of the water even if the water is remained in same, the related art steam generator or the washing machine having the same has a problem in that an ON/OFF period of the heater becomes short, and a process time period of a course becomes long.

Moreover, the related art steam generator or the washing machine having the same has a limitation in that the related art steam generator or the washing machine having the same is provided with a lowest water level sensing means for determining whether the heater in the same is submerged or not.

Furthermore, even though the related art steam generator has a sealing for preventing the water from leaking to an outside of the steam generator, since the sealing is provided at a position lower than the water level in the steam generator, the steam generator is vulnerable to water leakage.

Furthermore, the related art steam generator or the washing machine having the same supplies the water in the steam generator together with the steam by a pressure of the steam, washing efficiency has been poor.

DISCLOSURE OF INVENTION

Technical Solution

To solve the problems, an object of the present invention is to provide a steam generator and a washing machine having the same which can minimize remained water in the steam generator.

Another object of the present invention is to provide a steam generator and a washing machine having the same which can prevent the water stored in the steam generator from leaking.

Another object of the present invention is to provide a steam generator and a washing machine having the same which can prevent water in the steam generator from being supplied to clothes together with the steam by a steam spray pressure.

To achieve these objects and other advantages and in accordance with the purpose of the invention, as embodied and broadly described herein, a steam generator includes a lower case for storing water, a heater for heating the lower case, and an upper case on the lower case for discharging steam generated in the lower case.

In this case, the heater can be provided as one unit with the lower case such that the heater is not in contact with the water stored thus.

And, the lower case can include a base which forms a bottom surface of the lower case, and side walls which are upward extensions from the base, wherein the heater can be provided to the base not to be in contact with the water in the lower case.

And, the upper case can includes a top cover having a steam discharge pipe for discharging the steam, and a fastening cover which is a downward extension from the top cover to surround the side walls.

And, the steam generator can further include an air gap between the side walls and the fastening cover.

And, the steam generator can further include a sealing portion at top ends of the side walls for preventing the water and the steam in the lower case from leaking.

And, the steam generator can further include a steam supply passage having an outer wall portion which is an extension from the base toward the steam discharge pipe for preventing introduction of the water stored in the lower case, and an outer wall portion flow passage at a top of the outer wall portion for introduction of the steam.

And, the steam supply passage can include an inner wall portion which is an extension from the base toward the steam discharge pipe to position in the outer wall portion, and an inner wall portion flow passage at a top of the inner wall portion for introduction of the steam to an inside of the inner wall portion.

In this case, the outer wall portion flow passage and the inner wall portion flow passage can be provided to be misaligned each other.

And, the upper case can further include an outer wall portion flow passage cover which is an extension from the inside surface of the top cover toward the base spaced a predetermined distance from the outer wall portion flow passage.

In another aspect of the present invention, a washing machine includes the steam generator of the present invention, a clothes holding portion for providing a space for holding the clothes, a cabinet which forms an exterior of the washing machine and houses the clothes holding portion, and a bracket provided to the cabinet such that the steam generator is spaced from the cabinet and the clothes holding portion by predetermined distances, respectively.

In this case, the bracket can have one end coupled to the cabinet and the other end coupled to the upper case.

Or, the washing machine of the present invention can further include a frame for supporting the cabinet, wherein the one end of the bracket can be fixed to the frame and the other end of the bracket can be coupled to the upper case.

Advantageous Effects

The present invention has following advantageous effects.

The present invention can provide a steam generator and a washing machine having the same which can minimize remained water in the steam generator.

The present invention can provide a steam generator and a washing machine having the same which can prevent the water stored in the steam generator from leaking.

The present invention can provide a steam generator and a washing machine having the same which can prevent water in the steam generator from being supplied to clothes together with the steam by a steam spray pressure.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

Reference will now be made in detail to the specific embodiments of the present invention, examples of which are illustrated in the accompanying drawings. Wherever possible, the same reference numbers will be used throughout the drawings to refer to the same or like parts.

As far as there is no particular definition, all terms in the specification are the same with a general meaning of the term understood by persons skilled in this field of art, and, if the term used in the specification conflicts with the general meaning of the term, the meaning of the term used in the specification prevails.

In the meantime, a configuration or a control method of a device described hereinafter is provided only for describing embodiments of the present invention, but not for limiting scope of patent rights of the present invention.

A preferred embodiment of the present invention will be described with reference to drawings attached hereto.

Figure 1:
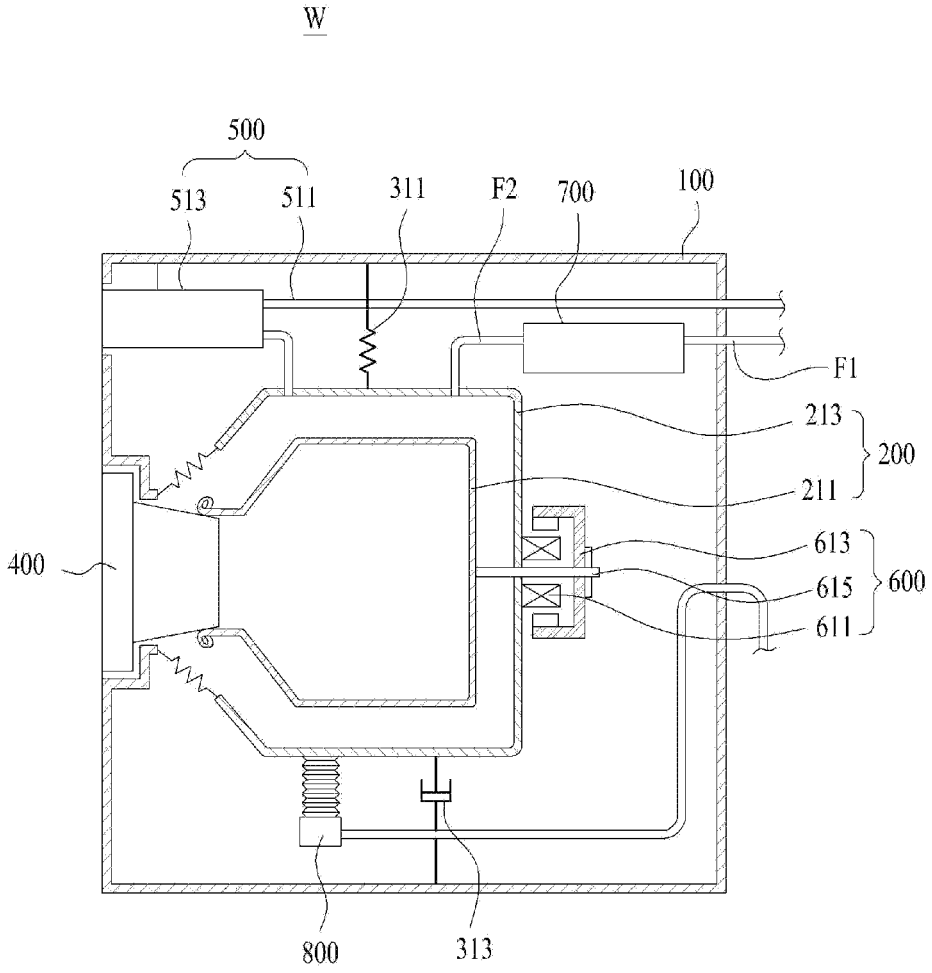
FIG. 1 illustrates a schematic view of a washing machine having a steam generator provided thereto in accordance with a preferred embodiment of the present invention.

FIG. 1 illustrates a schematic view of a washing machine having a steam generator provided thereto in accordance with a preferred embodiment of the present invention. An entire configuration of the washing machine will be described with reference to FIG. 1.

Referring to FIG. 1, the washing machine W includes a cabinet 100 which forms an exterior of the washing machine, and a clothes holding portion 200 in the cabinet for holding clothes.

The clothes holding portion 200 can include a tub 213 in the cabinet for holding washing water, and a drum 211 rotatably mounted in the tub.

However, since the tub is provided for washing clothes by using the washing water, if it is a case a washing machine which does not use the washing water is produced, the tub is not an essential component.

That is, in a case a washing machine is produced for sterilization or deodoring of the clothes by using steam, or a washing machine is produced for drying wet clothes by using hot air, it does not matters even if the clothes holding portion has a drum only.

A washing machine of the present invention will be described with reference to a washing machine having a tub for convenience's sake.

The tub 213 has an opening in one side for introduction of the clothes thereto, and the drum 211 is provided to have a drum opening matched to the tub opening. In this case, the tub opening and the drum opening can be opened/closed by a door 400.

Therefore, by opening the door, a user can introduce/take out the clothes to/from the drum.

In the meantime, the tub 213 is supported by a tub supporter within the cabinet, for minimizing transmission of vibration from the drum to the cabinet through the tub. A spring 311 and a damper 313 can be one example of the tub supporter.

On a rear of the tub, there can be a driving unit 600 for rotating the drum.

The driving unit can include a stator 611 on the rear of the tub, a rotor 613 rotative by electromagnetic action with the stator, and a shaft 615 connected between the rear of the drum and the rotor.

And, the washing machine W can include a washing water supply unit 500 for supplying washing water required for washing.

The washing water supply unit 500 can have a supply hose 511 connected between a water supply source and the tub 213, and the supply hose 511 can be connected to the tub via a detergent box 513.

The detergent box is a unit for supplying detergent required for washing. If the supply hose is connected to the tub via the detergent box, the detergent and the washing water can be supplied required for the washing even without an additional devise or control.

In the meantime, it is preferable that the detergent box 513 may be drawn in a front direction of the cabinet 100. In this case, the supply hose can have a form of a bellows (not shown) for preventing the supply hose from separating from the detergent box even at the time the detergent box is taken out of the washing machine.

Moreover, the washing machine can include a draining unit 800 for draining the washing water from the tub 213, additionally. It is preferable that the draining unit has a drain pump connected to the tub and a drain hose.

And, the washing machine of the present invention includes a steam generator 700 for sterilization, and deodoring of the clothes, and washing water heating. The steam generator is a device for heating water supplied thereto from an outside of the washing machine to generate steam to be supplied to the tub. The related art steam generator is provided with a storage portion for storing the water, and a heater in the storage portion to be in contact with the water, directly.

However, since the related art steam generator has a structure in which the heater heats the water directly, the related art steam generator can cause a safety problem with the steam generator in a case where there is no water in the storage portion or the water remaining in the storage portion is at a level lower than the position the heater is mounted in the steam generator.

Therefore, the related art steam generator is required to have a minimum water level sensing means for determining whether the heater is submerged under the water or not, and a control unit stops operation of the heater if the control unit determines that the heater is not submerged under the water by means of the minimum water level sensing means.

That is, since the related art steam generator puts the heater into operation after re-supply of the water even if there is the water remained in the steam generator, the related art steam generator has a problem in that the initially supplied water can not be supplied in steam, entirely.

Moreover, since the related art steam generator or the washing machine having the same is required to put the heater into operation after re-supply of the water even if the water is remained in same, the related art steam generator or the washing machine having the same has a problem in that ON/OFF periods of the heater can not but become short, and a process time period of a course becomes long.

Moreover, the related art steam generator or the washing machine having the same has a limitation in that the related art steam generator or the washing machine having the same is provided with a lowest water level sensing means for determining whether the heater in the same is submerged or not.

Furthermore, even though the related art steam generator has a sealing for preventing the water from leaking to an outside of the steam generator, since the sealing is provided at a position lower than the water level in the steam generator, the steam generator is vulnerable to water leakage.

Furthermore, the related art steam generator or the washing machine having the same supplies the water in the steam generator together with the steam by a pressure of the steam, washing efficiency has been poor.

Therefore, the steam generator in accordance with a preferred embodiment of the present invention provides a steam generator devised to solve the problems of the related art steam generator. An entire configuration of the steam generator in accordance with a preferred embodiment of the present invention will be described with reference to FIG. 2.

Figure 2:
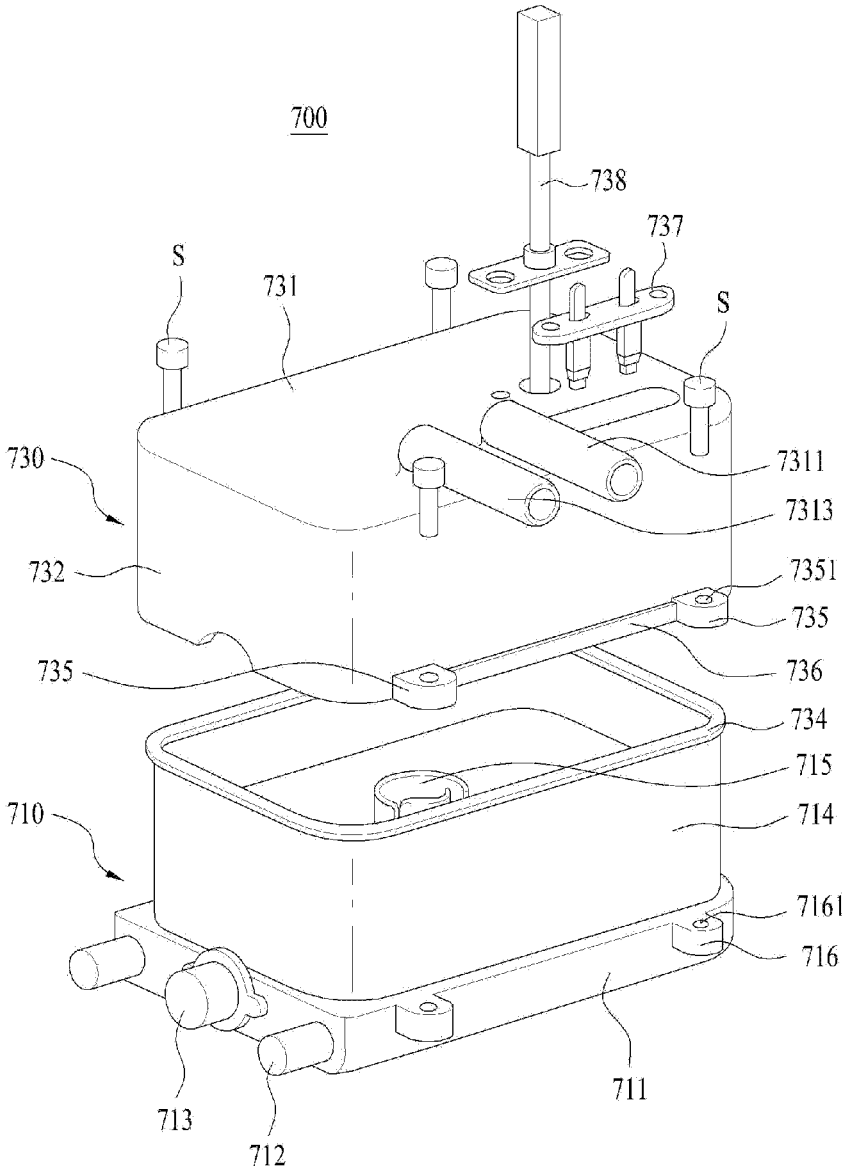
FIG. 2 illustrates an exploded perspective view of a steam generator in accordance with a preferred embodiment of the present invention.

Referring to FIG. 2, the steam generator 700 can include a lower case 710 and an upper case 730.

The lower case 710 is a component for storing and heating water supplied from an outside of the steam generator 700, and the upper case 730 is a component including a water supply pipe 7311 for supplying the water to the lower case, and a steam discharge pipe 7313 for discharging steam generated at the lower case.

The upper case 730 and the lower case 710 are fastened together with fastening portions 716 and 735 to be described later in detail.

Figure 3:
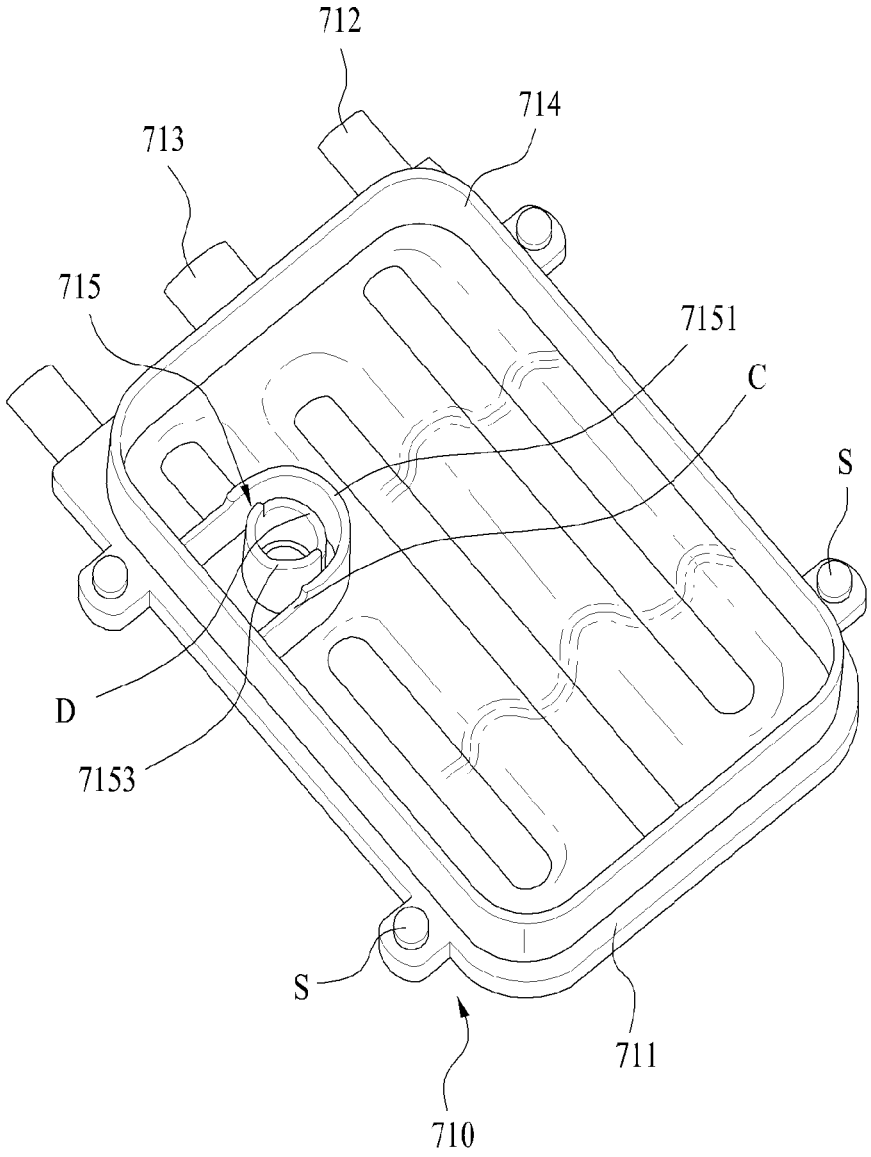
FIG. 3 illustrates a perspective view of a lower case.

FIG. 3 illustrates a perspective view of the lower case 710. A structure of the lower case will be described in detail.

The lower case 710 includes a base 711 which forms a bottom surface thereof, and side walls 714 which are upward extensions from the base. Therefore, the water introduced to the water supply pipe 7311 in the upper case is stored owing to the side walls.

In this case, it is preferable that the base 711 has a heater 712 provided thereto, and the heater 712 has a form of an electrothermal (heating) wire not in direct contact with the water stored in the lower case.

That is, the steam generator 700 is not of a type in which the heater does not heat the water stored by the base and the side walls directly, but of a type in which the heater 712 heats the base and the side walls to convert the water stored by the base and side walls into steam.

Therefore, since the steam generator 700 of the present invention is not of a type in which the heater is not in contact with the water directly, the determination of submergence of the heater in the water is not required like the related art steam generator, and since all of the water supplied to the lower case can be converted into the steam entirely, the problem water remaining in the steam generator can also be solved.

Since the present invention does not require determining whether the heater 712 is submerged in the water stored in the steam generator or not, the present invention does not require the minimum water level sensing means which is essential for the related art steam generator.

However, in this case, it is preferable that the lower case is formed of a heat conductive material.

In the meantime, the lower case 710 can include a temperature sensing unit 713 for sensing failure or overheating of the heater 712 to secure safety of the steam generator, additionally.

In this case, it is preferable that the temperature sensing unit 713 is provided to the base 711.

And, the lower case 710 can include a steam supply passage 715 for preventing the water from being discharged to the steam discharge pipe 7313 (See FIG. 2) in the upper case, additionally.

The steam supply passage 715 can include an outer wall portion 7151 which is an extension from the base 711 toward the steam discharge pipe 7313, and an outer wall portion flow passage C at a top of the outer wall portion 7151.

It is preferable that the outer wall portion 7151 is an upward extension from a bottom surface of the base 711 for preventing the water stored in the lower case from being introduced to a space formed by the outer wall portion.

In the meantime, the outer wall portion flow passage C can have a form of a hole passed through the outer wall portion 7151, or as shown, or a form of a cut-off portion in the outer wall portion at a top side thereof.

However, it is required to form the outer wall portion flow passage C at a position higher than a highest water level supplied to the lower case for discharging only steam generated in the lower case to the steam discharge pipe 7313.

That is, in a case a pressure of the steam being discharged through the steam discharge pipe 7313 is high, though the water stored in the lower case can be discharged through the steam discharge pipe together with the steam, the outer wall portion 7151 and the outer wall portion flow passage C prevent the water stored in the lower case from being discharged through the steam discharge pipe 7313 together with the steam.

Figure 4:
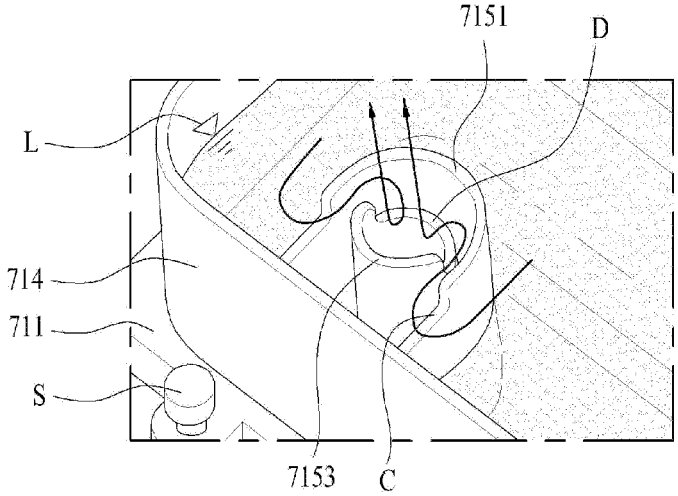
FIGS. 4A, 4B and 4C illustrate schematic views of steam supply passages, respectively.
Figure 4:
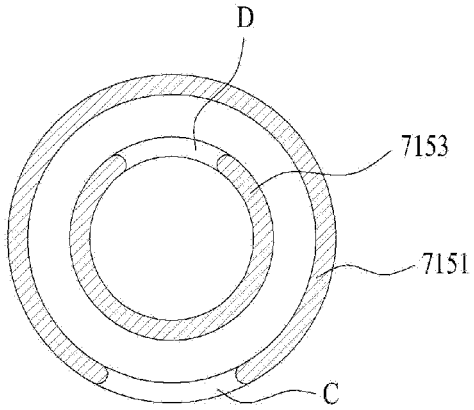
Figure 4:
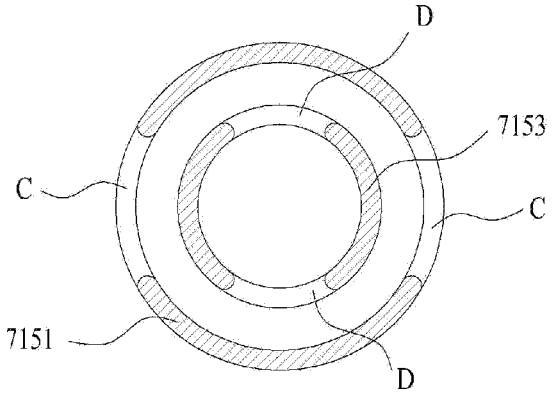

In the meantime, the highest water level L (See FIG. 4) is a highest water level of the water storable in the lower case set at the time of manufacturing the steam generator according to capacity of the steam generator.

It is preferable that the outer wall portion 7151 is formed of a material that can receive the heat the heater 712 provides to the base 711.

In this case, unitary aluminum die casting of the outer wall portion with the base can be an example.

This will provide an effect in which the water is converted into the steam earlier than ever because, not only the base and the side walls of the lower case, but also the outer wall portion 7151, form a surface to be in contact with the water in the lower case.

In the meantime, the steam supply passage 715 can include an inner wall portion 7153 to an inside of a space the outer wall portion 7151 forms, additionally.

This is for preventing the water from being discharged through the steam discharge pipe in a case the water is introduced to the outer wall portion flow passage despite of provision of the outer wall portion flow passage C at a position higher than the highest water level of the lower case.

The inner wall portion 7153 will be described with reference to FIGS. 4A~4C. The inner wall portion 7153 is an upward extension from the base 711 for enabling communication with the steam discharge pipe 7313, preferably provided in the outer wall portion 7151.

In this case, the inner wall portion 7153 has an inner wall portion flow passage D at a top side, preferably at a position misaligned to the outer wall portion flow passage C. This is for introduction of the steam only to the inner wall portion flow passage D even if the water and the steam is introduced to the outer wall portion flow passage C together.

If the steam and the water is introduced to the outer wall portion flow passage C, the steam and the water can move to the steam discharge pipe 7313 only when the steam and the water flow as marked with arrows in FIG. 4A.

Therefore, even if the water is introduced to the outer wall portion flow passage C together with the steam, since the water heavier than the steam is stored between the outer wall portion and the inner wall portion in a course the water moves from the outer wall portion flow passage to the inner wall portion flow passage, only the steam will be supplied to the steam discharge pipe 7313.

In this case, the inner wall portion 7153 can be formed of a material which can receive the heat the heater 712 provides to the base 711. This is for converting the water in a space between the outer wall portion and the inner wall portion into the steam and discharging the same.

In the meantime, though FIG. 4A illustrates a structure in which the outer wall portion 7151 is connected to the side wall 714, a shape of the outer wall portion can vary like FIG. 4B or 4C as far as the shape can produce above effect.

That is, as shown in FIGS. 4B and 4C, the outer wall portion 7151 can be an upward extension from the base separate from the side wall 714.

However, in the case of FIGS. 4B and 4C too, the outer wall portion flow passage C and the inner wall portion flow passage D are required to be opposite to each other for supplying only the steam to the steam discharge pipe 7313 even if both the steam and the water is introduced to the outer wall portion flow passage.

Figure 5:
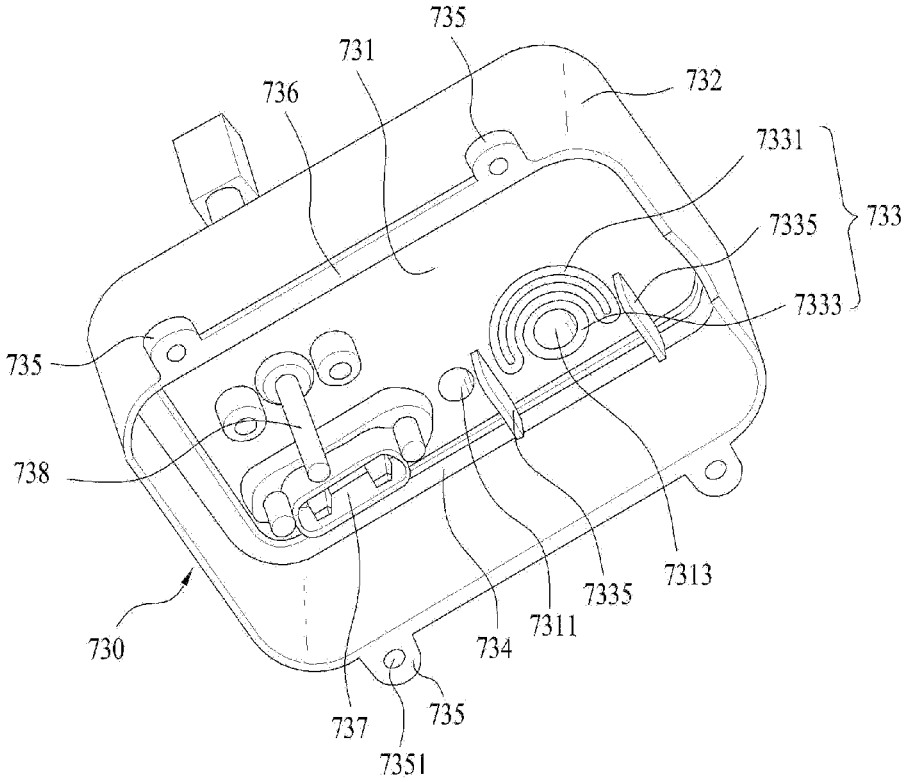
FIG. 5 illustrates a perspective view of an upper case.

FIG. 5 illustrates a perspective view of the upper case 730. The upper case will be described.

The upper case 730 includes a top cover 731 having a water supply pipe 7311 and a steam discharge pipe 7313 provided thereto, and a fastening cover 732 which is an extension from the top cover 731 to surround the side walls of the lower case.

That is, the lower case 710 and the upper case 730 are coupled together as the fastening cover 732 is brought into contact with the base 711, when the side walls 714 are housed in the fastening cover 732.

In the meantime, the steam generator can have an insulating portion provided thereto for preventing or minimizing transmission of the heat from the lower case to the upper case when the upper case and the lower case are coupled together, additionally.

Figure 6:
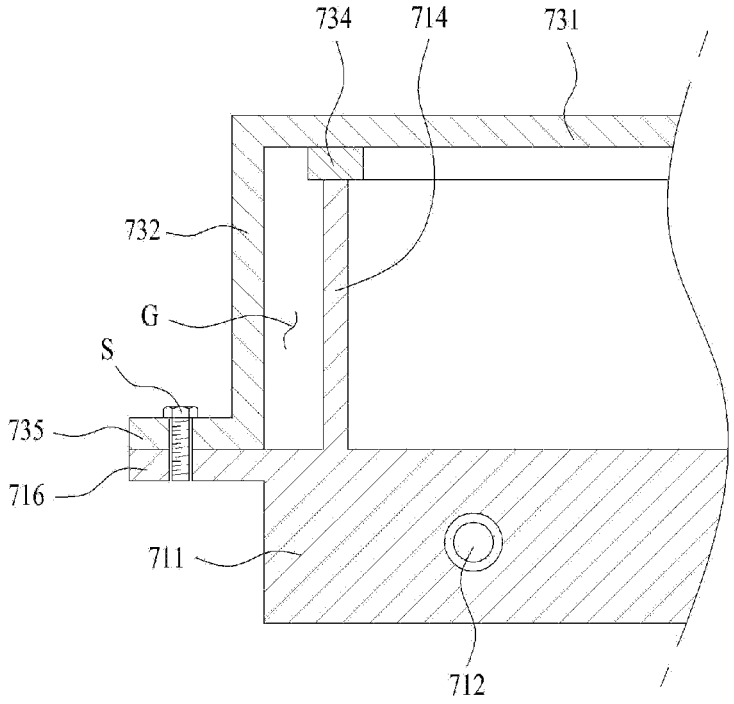
FIG. 6 illustrates a section showing fastening of an upper case to a lower case.

The insulating portion can be embodied as an air gap G (See FIG. 6) provided between the side wall and the fastening cover.

The air gap G (See FIG. 6) is means for preventing or minimizing transmission of the heat from the lower case to the upper case, and can be embodied as the fastening cover 732 and the side wall 714 are spaced a predetermined distance.

Therefore, by minimizing transmission of the heat of the heater 712 from the lower case 710 to the upper case (minimizing heat loss), fast conversion of the water in the lower case into the steam can be made possible, and malfunction of the sensing means 737 and 738 at the upper case can be prevented.

Moreover, the insulating portion can include a sealing portion 734 between the top cover 731 and the side wall 714 additionally, not only for preventing the heat from transmitting from the lower case to the upper case, but also for preventing the water and the steam in the lower case from leaking. The sealing portion will be described in detail in description of the fastening portion.

In the meantime, the water supply pipe 7311 provided to the top cover is connected to a water supply source for introduction of the water to the lower case. As shown in FIG. 1, though the water supply pipe 7311 can be connected to a connection pipe F1 provided to the supply hose 510 separately, it does not matter even if the supply hose 510 is branched for supplying the water.

The steam discharge pipe 7313 discharges steam from the lower case to the clothes through a connection pipe F2 provided between the clothes holding portion 200 and the steam discharge pipe 7313.

Moreover, the top cover 730 can have a flow passage cover 733 (See FIG. 5), additionally.

The flow passage cover 733, a portion in contact with a top of the steam supply passage 715 of the lower case, includes an outer wall portion cover 7331 which houses the outer wall portion 7151 and an inner wall coupling portion 7333 placed on the inner wall portion.

The outer wall portion cover 7331 is a projection from an inside surface of the top cover in conformity with a shape of a top of the outer wall portion for housing the top of the outer wall portion 7151. It is preferable that the outer wall portion cover is provided to seal the top of the outer wall portion.

However, the outer wall portion cover can have a shape which can vary as far as above effect can be produced.

That is, it does not matter even if the outer wall portion cover is provided, not in a shape which is in contact both with a top side inside surface and a top side outside surface of the outer wall portion, but in a shape which is in contact with the top side outside surface of the outer wall portion.

The inner wall coupling portion 7333 can be a projection of an end of the steam discharge pipe 7313 from the top cover 731 and can be placed in the inner wall portion 7153.

Moreover, the flow passage cover 733 can include an outer wall portion flow passage cover 7335, additionally.

The outer wall portion flow passage cover 7335 is provided to be spaced from the outer wall portion flow passage C by a predetermined distance, and is means for preventing the water in the lower case from being introduced to the outer wall portion flow passage C in a case the water splashes in the lower case.

That is, the water in the lower case boils owing to the heat transferred to the base, the side walls, and steam supply passage from the heater, and the water level of the water in the lower case moves up/down repeatedly in a course of boiling.

In this process, the water can be introduced to the outer wall portion flow passage C, and the outer wall portion flow passage cover 7335 cuts off a flow of the water toward the outer wall portion flow passage C caused by the up/down of the water level.

Figure 7:
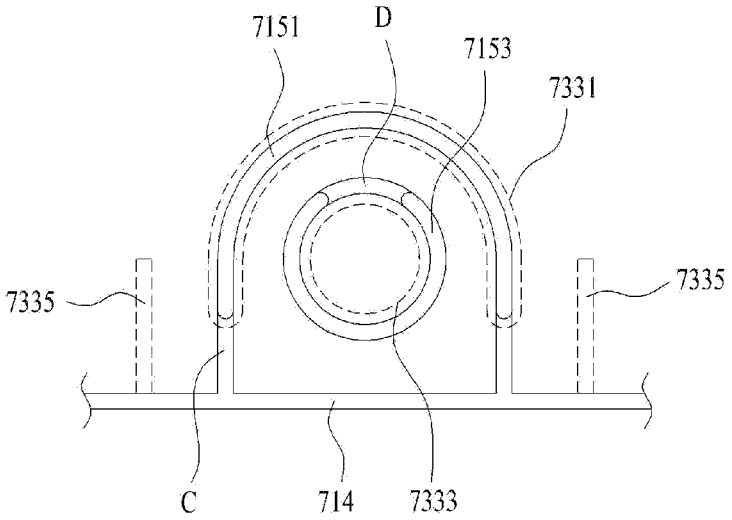
FIG. 7 illustrates a schematic view showing a state a steam supply passage is coupled to a flow passage cover.

FIG. 7 illustrates a schematic view showing a state a steam supply passage is coupled to a flow passage cover. Coupling of the outer wall portion cover 7331 to the outer wall portion 7151, coupling of the inner wall coupling portion 7333 to the inner wall portion 7153, and a position of the outer wall portion flow passage cover 7335 can be implemented as shown in FIG. 7.

Coupling of the other components to the upper case will be described with reference to FIG. 2.

There is a water level sensing means 737 provided to the top of the top cover 731, additionally.

The water level sensing means 737 is means for supplying an appropriate amount of water to the lower case. The water level sensing means in FIG. 2 can be provided with an electrode sensor having one pair of electrodes.

In this case, it is preferable that the one pair of electrodes is provided to be in contact with the water in a case the water is supplied to the highest water level of the lower case.

A steam generator having a related art electrode sensor is required to have a common electrode, a minimum water level sensing electrode, and a highest water level sensing electrode.

As described, the related art steam generator is of a type in which the heater is in direct contact with the water, and required to provide the lowest water level sensing electrode to sense a position of the heater not to be exposed to an outside of the water for securing safety of the steam generator.

However, in the steam generator of the present invention, since the heater 712 is not in contact with the water though the heater 712 is provided to the base, the steam generator of the present invention can dispense with the lowest water level sensing electrode.

That is, the water level sensing means provided to the steam generator of the present invention is adequate if the water level sensing means can sense only the highest water level of the steam generator.

In the meantime, the top cover 731 may have a temperature sensing means for sensing a temperature of the water.

The temperature sensing of the water in the steam generator can be utilized as data collection means required for control of the steam generator, such as determination on malfunction or the like as well as supply of the washing water of a certain temperature to the tub.

The fastening portions 735 and 716 which fasten the upper case 730 to the lower case 710 will be described.

The fastening portions can be provided to an upper flange 735 provided to the fastening cover 732 and a lower flange 716 provided to the side wall 714, respectively.

In this case, it is preferable that the upper flange and the lower flange have holes 7351 and 7161 for enabling fastening members S to pass therethrough, respectively.

In the meantime, the fastening cover 732 can have a reinforcing rib 736 provided thereto, additionally.

Since the steam generator of the present invention is of a type in which the heater heats the lower case, and the heated lower case converts the water therein into the steam, thermal deformation of the cases is liable to accompany.

Therefore, the thermal deformation of the upper case or the lower case causes the fastening member S to be subjected to a great shearing force, and in order to prevent the fastening member S from breakage, it is required to fabricate a fastening member having a great strength, or increase a number of fastening portions (A number of the upper flange and the lower flange).

However, since the steam generator of the present invention has the reinforcing rib 736 provided to a lower end of the fastening cover to minimize the thermal deformation of the upper case, even if the fastening member of the high shearing strength is not applied, a number of the fastening portions can be minimized.

However, because the thermal deformation of the upper case can be minimized once the reinforcing ribs are provided along an outside circumference of the fastening cover, it is not necessary to limit positions of the reinforcing ribs to the lower end of the fastening cover.

In the meantime, though FIG. 2 illustrates a case in which four upper and lower flanges 735 and 716 are provided to the upper case and the lower case respectively, those are only an example, and numbers of the upper flanges and the lower flanges are not limited.

However, as shown in the drawing, if four upper flanges are provided, the reinforcing ribs are provided between the upper flanges, which is preferable in view of fabrication time period and cost.

An insulating portion will be described, which can prevent or minimize transmission of heat from the lower case to the upper case at the time the upper case is fastened to the lower case.

As described before, the insulating portion can be embodied as the air gap G and the sealing portion 734.

The sealing portion 734 prevents, not only the transmission of the heat from the lower case to the upper case, but also leakage of the steam or water from the steam generator to an outside of the case.

However, it is preferable that the sealing portion 734 is provided in a space formed by the top cover 731 and the side wall 714, and more preferably at a position higher than a position where the fastening portions 716 and 735 are provided thereto.

The sealing portion of the related art steam generator is provided at a position the fastening portions are formed, or lower than the water level of the water in the steam generator.

That is, in the related art steam generator, the upper case is fastened to the lower case having no side walls 714 to form a space for storage of the water for steam generation, and the related art sealing portion is provided along a joining portion of the upper case and the lower case.

Therefore, since the related art steam generator has the sealing portion provided at a position lower than the highest water level of the water in the steam generator, the related art steam generator has possibility of water leakage.

However, if the sealing portion is provided at a position higher than the highest water level of the water in the lower case like the sealing portion 734 of the present invention, the possibility of leakage of the water or the stem to the outside of the steam generator can be excluded from a source.

Fastening portion in accordance with another preferred embodiment of the present invention will be described with reference to FIG. 8.

Figure 8:
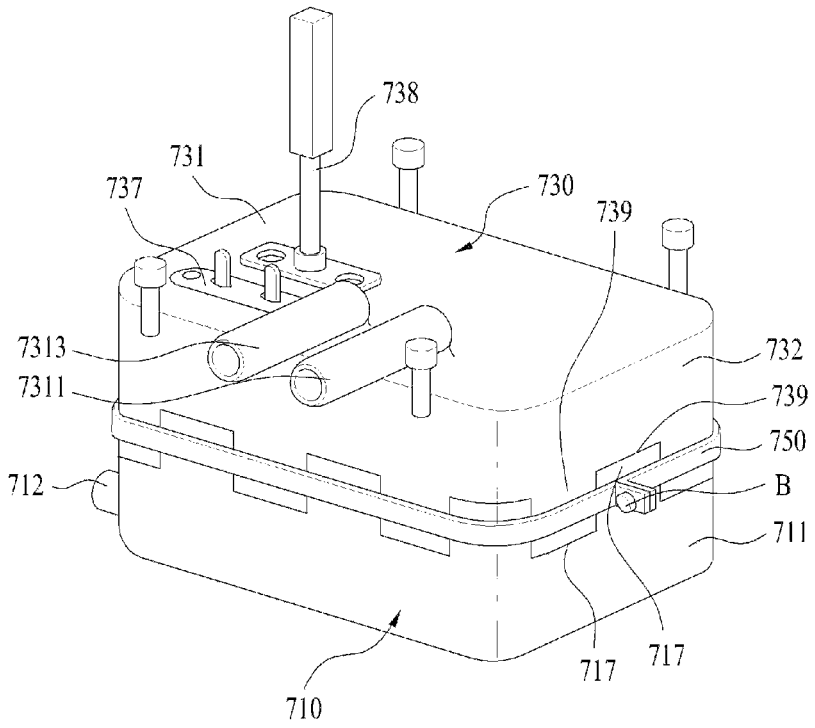
FIG. 8 illustrates a perspective view of a fastening portion in accordance with another preferred embodiment of the present invention.

In the foregoing embodiment, though a case has been described, in which the fastening portion has the upper flange 735 and the lower flange 716, the fastening portion can be a fastening portion as shown in FIG. 8.

That is, the fastening portion of the embodiment can have upper projection/recess portions 739 provided to the fastening cover 732 and lower projection/recess portions 717 provided to the base 711.

It is preferable that the upper projection/recess portions are provided along an edge of the fastening cover, and the lower projection/recess portions are provided to a top end of the base 711 so as to engage with the upper projection/recess portions.

Moreover, the fastening portion of the embodiment may have a securing portion 750 for securing the upper projection/recess portions and the lower projection/recess portions.

In this case, it is preferable that, by fastening both ends of the securing portion 750 with a fastening member B like a screw, separation of the upper case from the lower case can be prevented.

That is, the securing portion, not only prevents the upper case and the lower case from separating, but also minimizes the thermal deformation of the upper case and the lower case.

Coupling of the steam generator to the cabinet will be described with reference to FIG. 1.

The steam generator 700 of the present invention is of a type in which the lower case 710 is heated by the heater 712 to convert the water in the lower case into the steam.

Therefore, it is preferable that the steam generator 700 is provided between the cabinet 100 and the clothes holding portion 200 for prevention of accident caused by negligence of safety, but not in contact thereto.

That is, it is preferable that the steam generator is provided such that an outside surface thereof is spaced from an inside surface of the cabinet 100 by a predetermined distance as well as from an outside surface of the tub 213 (An outside surface of the drum if the washing machine is only for drying) by a predetermined distance.

This is for preventing direct contact of the cabinet and the clothes holding portion to the steam generator even if a surface temperature of the steam generator 700 becomes high for preventing transmission of the heat from the steam generator to the cabinet or the clothes holding portion.

Above effect can be produced by a bracket (not shown) which fixes a position of the steam generator.

That is, if the bracket is provided between the steam generator and a top side of the cabinet (or between the steam generator and a rear side of the cabinet), enabling to prevent transmission of the heat from the steam generator, not only to the cabinet, but also to the clothes holding portion, a possible accident caused by negligence of safety can be prevented.

In this case, though the bracket can be provided separate from the cabinet or the steam generator, the bracket can be provided to a frame (Not shown) provided for securing the cabinet as one unit, or the steam generator as one unit.

However, in any case, it is preferable that the bracket is provided to be connected to the upper case of the steam generator.

This is because the upper case has a temperature lower than the lower case when the steam generator is in operation.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A steam generator mounted in a washing machine comprising:

a lower case for storing water, the lower case having a base which forms a bottom surface of the lower case and side walls which are upwardly extended from the base;

a heater for heating the lower case;

an upper case on the lower case;

a top cover having a steam discharge pipe for discharging steam; and a steam supply passage comprising:

an outer wall portion including surfaces other than the side walls which upwardly extends from the base for preventing the water stored in the lower case from being introduced to the steam discharge pipe; and an outer wall portion flow passage at a top of the outer wall portion for discharging only steam generated in the lower case;

an inner wall portion which extends from the base toward the steam discharge pipe and is surrounded by the outer wall portion; and an inner wall portion flow passage at a top of the inner wall portion for introduction of the steam to an inside of the inner wall portion, wherein the outer wall portion flow passage and the inner wall portion flow passage are misaligned with each other.

2. The steam generator as claimed in claim 1, wherein the heater is within the lower case such that the heater is not in contact with the water stored therein.

3. The steam generator as claimed in claim 1, wherein the upper case comprises a water level sensing means for measuring only a highest water level of the water in the lower case.

4. The steam generator as claimed in claim 1, wherein the outer wall portion is connected to the side wall.

5. The steam generator as claimed in claim 1, wherein the outer wall portion is separated from the side wall.

6. The steam generator as claimed in claim 1, wherein the lower case comprises:

a plurality of side walls which extend upwardly from the base, wherein the heater is within the base so as not to be in contact with the water in the lower case.

7. The steam generator as claimed in claim 6, wherein the upper case comprises:

a fastening cover which extends downward from the top cover to surround the side walls.

8. The steam generator as claimed in claim 7, further comprising:

an air gap between the side walls and the fastening cover.

9. The steam generator as claimed in claim 7, further comprising:

a sealing portion disposed on top ends of the side walls for preventing the water and the steam in the lower case from leaking.

10. The steam generator as claimed in claim 7, further comprising:

a reinforcing rib which projects from a lower outside circumference of the fastening cover for suppressing thermal deformation of the upper case.

11. The steam generator as claimed in claim 7, further comprising:

a fastening portion for fastening the upper case to the lower case, wherein the fastening portion includes an upper portion at the fastening cover and a lower portion at the base for engaging with the upper portion, and wherein the upper portion is a projection and the lower portion is a recess or vice versa.

12. The steam generator as claimed in claim 7, further comprising:

a fastening portion for fastening the upper case to the lower case, wherein the fastening portion comprises:

a lower flange at the base; and at least one upper flange at a lower end of the fastening cover for coupling to the lower flange.

13. The steam generator as claimed in claim 12, wherein the at least one upper flange comprises two upper flanges spaced apart from each other along the lower end of the fastening cover, and the reinforcing rib is provided between the two upper flanges for suppressing thermal deformation of the upper case.

14. The steam generator as claimed in claim 7, wherein the outer wall portion upwardly extends from the base toward the steam discharge pipe for preventing introduction of water stored in the lower case to the upper case.

15. The steam generator as claimed in claim 14, wherein the outer wall portion flow passage is at a position higher than a highest water level of water storable in the lower case.

16. The steam generator as claimed in claim 14, wherein the outer wall portion includes a heat conductive material.

17. The steam generator as claimed in claim 14, wherein the upper case further comprises:

an outer wall portion cover which projects from the top cover for housing a top of the outer wall portion.

18. The steam generator as claimed in claim 14, wherein the steam discharge pipe projects from an inside surface of the top cover so as to be placed in a top of the inner wall portion, and the upper case further comprises an outer wall portion cover which projects from the top cover so as to be housed in a top of the outer wall portion.

19. The steam generator as claimed in claim 18, wherein the upper case further comprises an outer wall portion flow passage cover which extends from the inside surface of the top cover toward the base and is spaced a predetermined distance from the outer wall portion flow passage.

20. A washing machine comprising:

a clothes holding portion for holding clothes and receiving steam generated by a steam generator;

a cabinet forming an exterior of the washing machine and housing the clothes holding portion;

a bracket spacing the steam generator from the cabinet and the clothes holding portion by predetermined distances, respectively; and a steam generator, wherein the steam generator comprises:

a lower case for storing water, the lower case having a base which forms a bottom surface of the lower case and side walls which are upwardly extended from the base;

a heater for heating the lower case;

an upper case on the lower case;

a top cover having a steam discharge pipe for discharging steam; and a steam supply passage comprising:

an outer wall portion including surfaces other than the side walls which upwardly extends from the base for preventing the water stored in the lower case from being introduced to the steam discharge pipe, and an outer wall portion flow passage at a top of the outer wall portion for discharging only steam, an inner wall portion which extends from the base toward the steam discharge pipe and is surrounded by the outer wall portion, and an inner wall portion flow passage at a top of the inner wall portion for introduction of the steam to an inside of the inner wall portion, wherein the outer wall portion flow passage and the inner wall portion flow passage are misaligned with each other, and wherein the outer wall portion is in the lower case.

21. The washing machine as claimed in claim 20, wherein the bracket has one end coupled to the cabinet and another end coupled to the upper case.

22. The washing machine as claimed in claim 21, further comprising:

a frame for supporting the cabinet, wherein the one end of the bracket is fixed to the frame and the another end of the bracket is coupled to the upper case.

* * * * *